US005509175A

United States Patent [19]

Baughan et al.

[11] Patent Number: 5,509,175

[45] Date of Patent: Apr. 23, 1996

[54] VEHICLE DOOR HINGE WITH COMPOUND ROLLER STRUCTURE HAVING ONE PIECE SPOOL, SYNTHETIC BEARING SLEEVE AND PLIABLE ANNULAR RING

[75] Inventors: Steven M. Baughan, Grand Blanc; Eric T. Hartman, Sterling Heights, both of Mich.

[73] Assignee: ITT Corporation, New York, N.Y.

[21] Appl. No.: 173,771

[22] Filed: Dec. 22, 1993

[51] Int. Cl.[6] ..... E05D 5/14

[52] U.S. Cl. ..... 16/332; 16/386

[58] Field of Search ..... 16/332, 333, 334, 16/335, 386; 492/28, 37

[56] References Cited

U.S. PATENT DOCUMENTS

| | | | |
|---|---|---|---|
| 3,710,417 | 1/1973 | Berman et al. | 16/142 |
| 4,419,788 | 12/1983 | Prout | 16/300 |
| 4,532,675 | 8/1985 | Salazar | 16/335 |
| 4,800,624 | 1/1989 | Whitefoot et al. | 16/332 |
| 4,800,856 | 1/1989 | Baltz et al. | 74/569 |
| 5,018,243 | 5/1991 | Anspaugh et al. | 16/335 |
| 5,323,512 | 6/1994 | Little | 16/334 |

OTHER PUBLICATIONS

Society Of Automotive Engineers, Aerospace Material Specification, Revised Oct. 1, 1991.

Kolene Corporation Brochure, "Salt Bath Nitriding vs. Gas Nitriding", Copyright 1988.

Society Of Automotive Engineers, SAE Technical Paper Series 862023, Dec. 8–10, 1986.

Metals International Article, "Salt Bath Nitriding Growing In Japan, Europe", Reprinted From Metal Progress Mag., Aug. 1986.

Kolene Corporation,"Proceedings, Salt Bath Nitriding Seminar", Oct. 29, 1985.

Kolene Corporation Bulletin QL–84, "The QPQ Process", copyright 1983.

Kolene Corporation Brochure, "Melonite", undated.

*Primary Examiner*—Maurina T. Rachuba
*Assistant Examiner*—Kenneth J. Hansen
*Attorney, Agent, or Firm*—Robert P. Seitter; J. Gordon Lewis

[57] ABSTRACT

An automotive door hinge assembly is provided with a hold-open device with a leaf spring member carried on a first part of a hinge assembly, and a compound roller carried on a second part of the hinge assembly, wherein the compound roller engages the leaf spring member with the combination of a flexible and resilient first material portion and a hard, rigid second material portion of the roller assembly during its motion between the door open and door closed positions. Preferably, the hard, rigid second material portion of the roller assembly is made of a single piece spool having a first, reduced diameter, annular shoulder interposed between two, longitudinally spaced, enlarged diameter, annular shoulders. To reduce noise, a synthetic bushing is preferably disposed between the spool and a roller pin of the hinge mechanism and the first annular shoulder has a roughened surface engageable with the first material portion.

18 Claims, 2 Drawing Sheets

VEHICLE DOOR HINGE WITH COMPOUND ROLLER STRUCTURE HAVING ONE PIECE SPOOL, SYNTHETIC BEARING SLEEVE AND PLIABLE ANNULAR RING

FIELD OF THE INVENTION

The present invention relates generally to automobile door hinges and more specifically to such hinges which provide door check means for holding the door in an open position.

BACKGROUND OF THE INVENTION

It is well-known in the automotive door hinge art to provide check spring mechanisms which function to exert a force on the portion of a hinge carrying the door to control movement to and away from the fully opened position of the door. For example, one automotive manufacturer employs a hinge in certain automobiles it produces which includes a bent-over strike tang on the door portion of the hinge which slides along and compresses a leaf spring member carried on the body portion of the hinge to control movement about the fully opened position. While this has been shown to be a simple and effective mechanism, lubrication is required for easy and quiet operation, and the maintaining of contact with the leaf spring during hold open operation increases the cyclic stress life requirements of the components.

Other examples of prior art hinges may be seen in U.S. Pat. No. 3,370,317 to Marchione and U.S. Pat. No. 3,931,664 to Makano, et al. These devices both disclose rather complex structures employing rollers engaging the check spring. Both are disadvantageously complex for some applications and the latter requires significant lubrication to facilitate the long rolling contact of its rollers with its spring.

Another example of a door hinge with an integral check is U.S. Pat. No. 4,532,675 issued to Salazar. This automotive door hinge assembly provides a hold-open device consisting of a leaf spring carried on the body part of the hinge and a roller carried in a cage portion of the door part which engages the leaf spring only during the portion of its travel proximate the door-open position. The roller in this door hinge is disclosed as preferably formed from reinforced nylon. While this has been shown to be a simple and effective mechanism, it has been found that the reinforced nylon roller typically does not wear in a uniform manner about its circumferential periphery. As a result, the reinforced nylon roller begins to contact the leaf spring in the same position during the open and close cycle, thereby wearing down particular portions of the cylindrical circumference, which results in a loss of the door check means for holding the door in the open position after repeated cycling of the mechanism.

A compound roller structure was first described in U.S. Pat. No. 5,018,243 assigned to the same assignee as the present invention. In this compound roller structure, various roller configurations were disclosed with multi-piece spools having two longitudinally spaced, enlarged diameter, annular shoulders to contact the spring and one reduced diameter annular shoulder interposed between the two enlarged shoulders for receiving the pliable annular ring. In the alternative, this patent also disclosed a compound roller structure having a single one piece spool that included one enlarged diameter, annular shoulder to contact the spring and a reduced diameter, annular shoulder to receive the pliable annular ring.

SUMMARY OF THE INVENTION

The present invention seeks to increase the operable life of the door hinge mechanism while providing for easy and quiet operation. This is accomplished by replacing the reinforced nylon roller of the previous door hinge mechanism with a composite construction having a very hard spool or rim made of material such as metal and a softer, more pliable, annular ring engaged on the spool. The softer and more pliable annular ring preferably has a greater external diameter than the outermost diameter of the spool or rim. In the preferred embodiment, the spool or rim is made from sintered steel or other metal and the annular silencer ring is made of polyester urethane or other flexible material capable of withstanding temperatures in the range from 400° F. to −40° F. The spool or rim of the roller is preferably made of a single piece, and includes a reduced diameter, first annular shoulder interposed between a pair of longitudinally spaced, enlarged diameter, second annular shoulders, wherein the diameter of the first annular shoulder is less than the diameters of the second annular shoulders, and the flexible annular ring has a through-bore adapted to engage on the first annular shoulder on the spool with its outer annular surface extending beyond the diameters of the second annular shoulders of the spool. It has been found that the expected cyclic life of the door hinge mechanism can be increased by providing a metal roller in place of the reinforced nylon roller disclosed in U.S. Pat. No. 4,532,675; however, this results in a door hinge mechanism that does not provide the desired quiet operation. Therefore, the present invention resolves this problem by providing a compound roller structure including the combination of a sintered steel spool or rim with a polyester urethane silencer roller or annular ring disposed on the sintered steel spool.

The present invention also provides a polyester urethane block or projection to urge the contoured leaf spring outwardly from the flat mounting portion of the door hinge assembly. The polyester urethane is also the preferred material for this portion of the door hinge assembly because it meets the temperature requirements of being capable of withstanding a temperature range between 400° F. and −40° F. The 400° F. temperature is required in order to withstand the paint baking process which automobiles are typically exposed to; and the −40° F. temperature is required in order to withstand the sub zero temperatures that automobiles are occasionally exposed to during normal use.

The present invention also includes a nylon bearing interposed between the metallic spool and the metallic pin to reduce noise levels therebetween. In order to reduce the production of noise between the metallic spool and the pliable annular ring, the first annular shoulder is provided with a roughed or knurled surface to reduce rotational movement between the spool and annular ring. To reduce corrosion, the metallic spool portion of the compound roller structure is preferably treated with a protective anti-corrosion process or coating.

BRIEF DESCRIPTION OF THE DRAWINGS

Other objects, features and advantages of the present invention will become readily apparent to those skilled in the automotive door hinge art from the following description, reference being made to the accompanying drawings in which like reference numerals refer to like parts throughout the various views wherein.

DESCRIPTION OF THE PREFERRED EMBODIMENT

Figure 1:
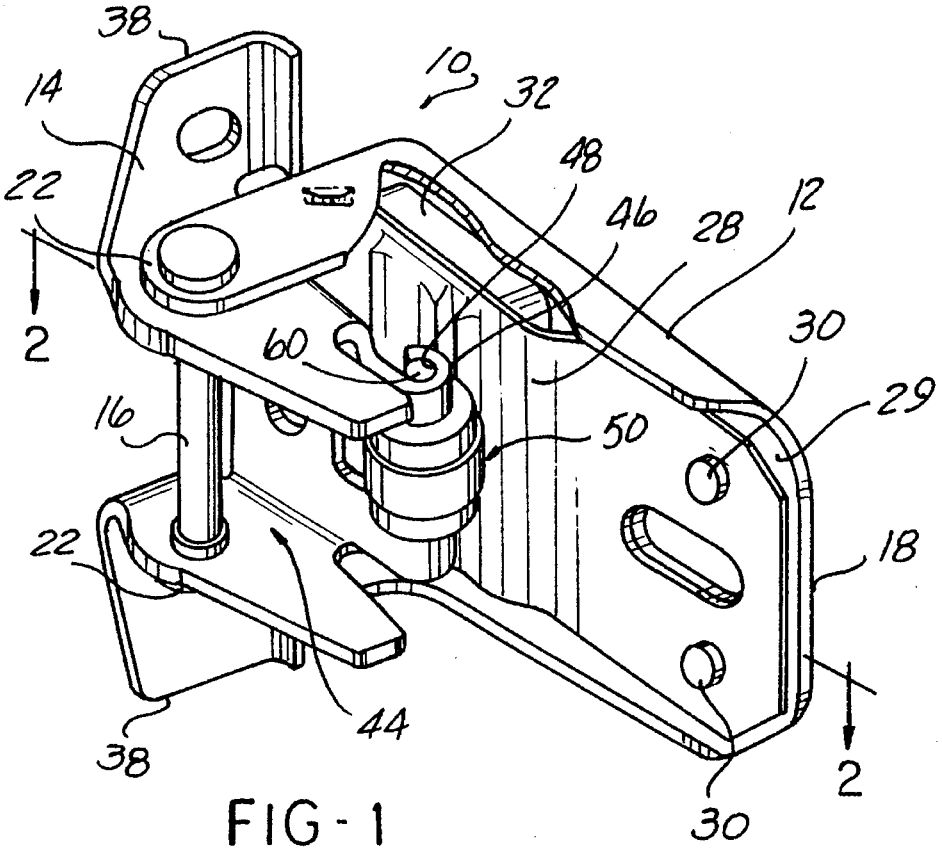
FIG. 1 is a perspective view of the hinge of the present invention in the door closed position.

Referring now to the drawings and in particular to FIG. 1 thereof, a hinge assembly 10 is illustrated as including generally a first plate 12 and a second plate 14 pivotally interconnected through a pin 16. The first plate 12, as can best be seen in FIGS. 2 and 3, includes a flat mounting portion 18 for abuttingly engaging a portion of a vehicle body and further includes upstanding bracket portions 22 for mounting the pin 16. Attachment of the mounting portion 18 to the vehicle body is preferably accomplished by conventional fasteners. A leaf spring member 28 is secured to the outer face 29 of the mounting part 18 by means of rivets 30. The leaf spring member 28 is preferably formed of one metal plate having a generally contoured surface providing first and second generally concave portions. It is urged generally outwardly toward the pivotal axis of pin 16 by provision of a flexible resilient block of material 32 disposed between the outer face 29 and the leaf spring member 28. In the preferred embodiment, the block of flexible and resilient material is made of polyester urethane, or any other similar material having the desired flexibility and resilience in addition to being capable of withstanding temperatures in a range from 400° F. to −40° F. for extended periods of time. A pair of stop portions 34 are formed in the brackets 22 of the first plate 12 adjacent the free end of the leaf spring member 28.

The second plate 14 includes a pair of mounting ears 38 through which conventional fasteners are inserted for fastening to a portion of the door of a vehicle. The second plate 14 also includes a cage portion 44 which is configured to receive the pin 16 and includes a pair of depending rolled-over tabs 46 for defining a pair of aligned apertures 48 for rotatably mounting a roller 50. The roller 50 is preferably formed with a compound structure having a very hard, single piece spool or rim 52 made of a material, such as metal, and a softer, more pliable, annular silencer 54 engaged on the spool 52. The softer and more pliable annular silencer 54 preferably has a greater external diameter than the outermost diameter of the spool 52. In the preferred embodiment, the spool 52 is made of sintered steel or other metal, and the annular silencer 54 is made of polyester urethane or other flexible material capable of withstanding temperatures in the range from 400° F. to −40° F.

Figure 4:
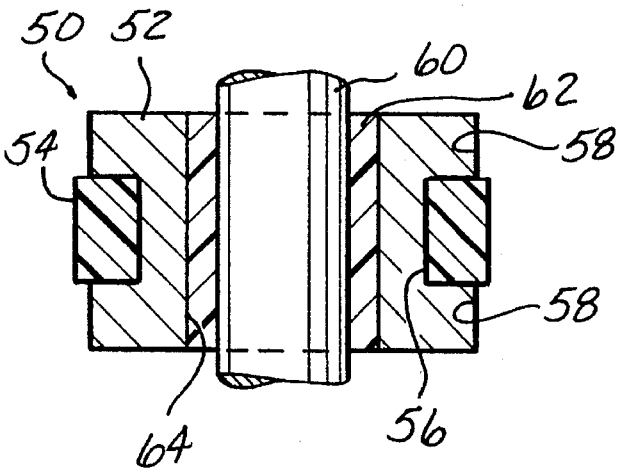
FIG. 4 is a cross-sectional detail view of a composite roller according to the present invention.
Figure 5:
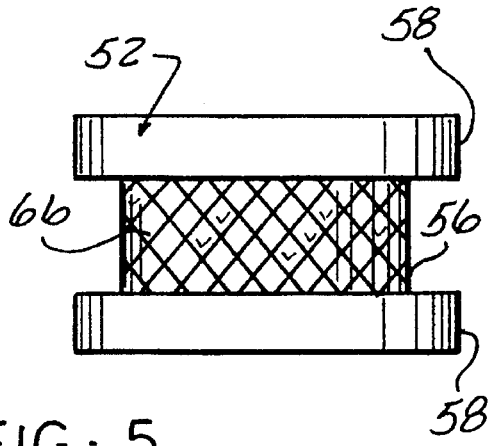
FIG. 5 is a detail view of a one-piece spool structure and knurled external surface according to the present invention.

Shown in FIGS. 4 and 5 is the preferred configuration for the single, unitary piece spool for the compound roller assembly 50. The spool 52 portion of the compound roller 50 includes a first, reduced diameter, annular shoulder 56 interposed between two, longitudinally spaced, enlarged diameter, second annular shoulders 58, wherein the diameter of the first annular shoulder 56 is less than the diameters of the second annular shoulders 58, and the flexible annular silencer 54 has a through-bore adapted to engage on the first annular shoulder 56 of the spool 52 with its outer annular surface extending beyond the diameters of the second annular shoulders 58 of the spool 52. FIG. 4 depicts the preferred embodiment of the roller assembly 50. In the preferred embodiment, the roller assembly 50 includes a single, one-piece, unitary spool 52. The spool 52 has a first, reduced diameter, annular shoulder 56 interposed between a pair of longitudinally spaced, enlarged diameter, second annular shoulders 58, wherein the first annular shoulder 56 has a diameter less than the diameters of the second annular shoulders 58. The silencer ring 54 having a through-bore adapted to engage the first annular shoulder 56 and further having an outer cylindrical periphery with a diameter greater than the diameters of the second annular shoulders 58. It has been found that the silencer ring 54 decreases the noise of operation of the hinge mechanism while the hard material spool 52 increases the longevity of the mechanism. The roller assembly 50 also includes a bushing or bearing 62 that is press fit into the spool 52 before the spool 52 is mounted on pin 60 to allow rotation of the roller assembly 50 as it contacts the leaf spring member 28. Preferably, the bushing or bearing 62 is synthetic and preferably can be made of nylon. It has been found that a nylon bushing does not suffer the same disadvantages as previously experienced with nylon rollers. In particular, it is believed that the nylon bushing does not experience uneven wear due to the protection of the metallic spool. The metallic spool 52 appears to dissipate and evenly distribute the force on the nylon bushing, thereby preventing the problems of uneven wear associated with a nylon roller. The nylon bushing meets the temperature requirements of the hinge mechanism and reduces the noise attributable to the rotation of the spool 52 on the pin 60.

An optional configuration can be seen in FIG. 5, wherein the spool 52 has a roughened or knurled external surface 66 on the first annular shoulder 56. This roughened or knurled surface 66 helps to prevent or reduce the relative rotational movement between the spool 52 and the pliable annular ring 54, thereby reducing or eliminating any noise associated with the relative movement. Preferably, the spool 52 is treated to prevent or reduce corrosion. The preferred anti-corrosion treatment is salt bath nitriding, commercially known as MELONITE™, as described in SAE Technical Paper Series 862023 published December, 1986, which is incorporated by reference herein. Preferably, the treatment includes the quench-polish-quench treatment, commercially known as QPQ™, as described therein.

The spool 52 has a through-bore 64 adapted to receive the bushing 62 to engage with pin 60 positioned within apertures 48 formed by rolled-over tabs 46 of cage portion 44. As depicted in FIG. 4, the silencer ring 54 is disposed on top of the first annular shoulder 56 and is interposed between the pair of second annular shoulders 58. In addition, the spool 52 may be sized accordingly to generally span the entire longitudinal length of pin 60 between the rolled-over tabs 46 of the cage portion 44.

Figure 2:
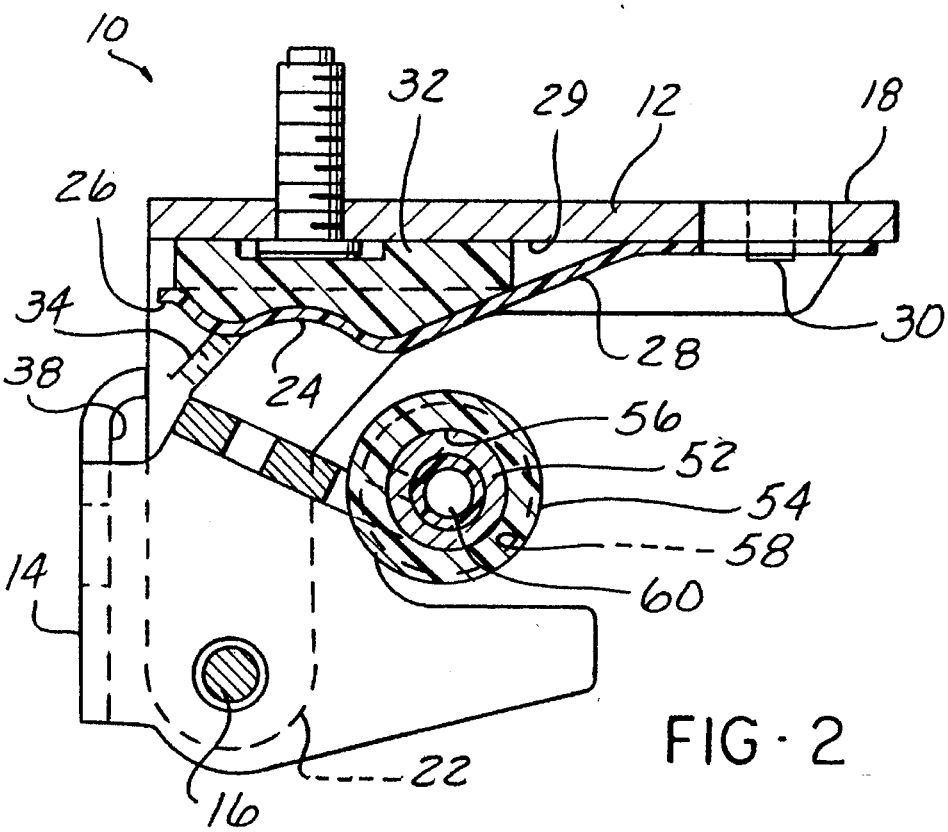
FIG. 2 is a cross-sectional view of the hinge of the present invention in the door closed position taken along line 2—2 of FIG. 1.
Figure 3:
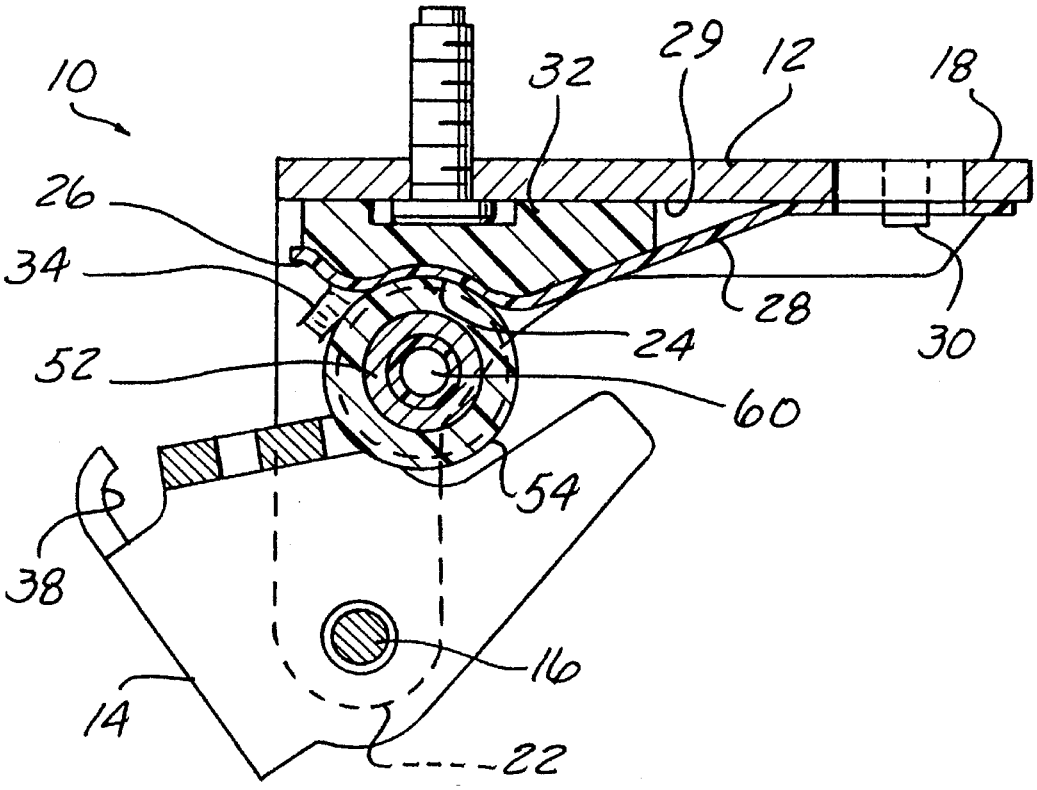
FIG. 3 is a cross-sectional view similar to FIG. 2 wherein the hinge of the present invention is shown in the first stop of a door-open position.

Operation of the preferred embodiment can best be understood by reference to FIGS. 2 and 3 in which the closed and partially open positions of the hinge assembly 10 are illustrated. It can be seen that in the door closed position of FIG. 2, the roller 50 carried in cage portion 44 of the door plate 14 is spaced from the upper surface of the leaf spring member 28. Upon movement of the door toward the open position of FIG. 3, the roller 50 is brought into engagement with the surface of the leaf spring member 28 and deflects the leaf spring member 28 inwardly toward the body of the vehicle. After reaching the position shown in FIG. 3, the roller 50 is generally disposed within the first generally concave portion 24 of the leaf spring member 280providing first check means of the door in a partially open position. Further movement of the door in a counter clockwise rotation about pin 16 will dispose the roller assembly 50 at the second generally concave portion 26 of leaf spring member 28 adjacent the terminus edge of the leaf spring member 28. The roller 50 is maintained in rolling contact with the leaf spring member 28 during its movement through the first and second generally concave portions 24 and 26 of the leaf spring member 28. Each of the generally concave portions 24 and 26 of the leaf spring member 28 provide door check means for holding the door in an open position. The generally concave portion 24 holds the door in a partially open position, while the generally concave portion 26 holds the door in the outermost open position of its movement. Clockwise movement toward the closed position from the open position is resisted by the leaf spring member 28 when the roller 50 is engaged within the generally concave portions 24 and 26 of the leaf spring member 28. Movement in the opening direction is limited by the stops 34 which are abuttingly engageable with edges of the cage portion 44.

It has been found that the operation described proceeds smoothly due to the rolling contact between the roller assembly 50 and the leaf spring member 28 and it has been further found that lubrication of the upper surface of the leaf spring member 28 is usually unnecessary using this compound dual element structure for the roller assembly.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation permissible under law so as to encompass all such modifications and equivalent structures.

What is claimed is:

1. In a hinge assembly for a vehicle having a body and a door including a first plate adapted to be secured to the body of the vehicle, a second plate adapted to be secured to the door of the vehicle, pin means for pivotally connecting the first plate to the second plate about a first axis, third plate means secured to one of said first and second plates at one end and having a free end positioned intermediate between said one of said first and second plates and the other of said first and second plates proximate the pin means, spring means positioned between said third plate means and said one of said first and second plates for biasing said third plate means outwardly from said one of said first and second plates and a roller member mounted on a pin for rotation about a second axis and movable with said other of said first and second plates between a door-closed position and a door-opened position, wherein said roller member is spaced from said third plate means when in said door-closed position, said roller member engageable with said third plate means when moving between said door-opened position and said door-closed position causing deflection of said third plate means against said spring means, the improvement comprising:

said roller member having a hard, rigid spool portion and a flexible, resilient silencer portion, said silencer portion adapted to engage said spool portion such that the spool portion and the silencer portion engage said third plate means when moving between said door-opened and door-closed positions, said spool portion of said roller member formed of a single piece having a first, reduced diameter, annular shoulder interposed between two, longitudinally spaced, enlarged diameter, annular shoulders, said first annular shoulder of said spool having a knurled surface engageable with said silencer portion.

2. The hinge assembly of claim 1 further comprising a synthetic bushing of nylon material disposed between said spool and said pin.

3. The hinge assembly of claim 1 further comprising said spool treated by a salt bath nitriding process to prevent corrosion.

4. The hinge assembly of claim 1 further comprising said flexible resilient silencer portion of said roller member having a through bore adapted to engage with said first annular shoulder of said hard rigid spool portion, and said silencer portion having an outer circular periphery with a diameter greater than said diameters of said second annular shoulders of said spool portion.

5. The hinge assembly of claim 1, wherein said flexible, resilient silencer portion of said roller member is constructed of a material capable of withstanding temperatures in a range from 400° F. to –40° F.

6. The hinge assembly of claim 1, wherein the flexible, resilient silencer portion is made of a polyester urethane.

7. The hinge assembly of claim 1, wherein said hard, rigid spool portion is made of a metal material.

8. The hinge assembly of claim 1, wherein said spring means comprises a block of flexible and resilient material capable of withstanding temperatures in a range from 400° F. to –40° F.

9. The hinge assembly of claim 1 further comprising:

generally concave surface means formed in said third plate means adjacent said free end defining at least one generally concave surface portion facing away from said one of said first and second plates, wherein reverse movement of said door is resisted by said spring means when said roller member is disposed in said generally concave surface portion of said concave surface means.

10. In a hinge assembly of the type having a body plate adapted to be secured to the body of a vehicle, a door plate pivotally connected about a vertical hinge axis to the body plate and adapted to be secured to a door of the vehicle, and a check spring mounted on one of the plates operably engageable with a striker member carried by the other of the plates to hold the door plate in a door-opened position, the improvement comprising:

said striker member including a roller member mounted on a pin for rotation about a second axis and movable with said other of said plates between a door-closed position and a door-opened position, wherein said roller member is spaced from said one of said plates when in said door-closed position, said roller member engageable with said one of said plates when moving between said door-opened position and said door-closed position causing deflection of said check spring, said roller member having a hard, rigid, one-piece spool portion and a flexible, resilient silencer portion, said silencer portion adapted to engage said spool portion such that the spool portion and the silencer portion engage said one of said plates when moving between said door-opened and door-closed positions, said roller member having a knurled surface engageable with said silencer portion, said hard rigid spool portion of said roller member formed of a single piece having a first, reduced diameter, annular shoulder interposed between two, longitudinally spaced, enlarged diameter, annular shoulders, wherein the first annular shoulder has a diameter less than the diameters of the second annular shoulders and said first annular shoulder includes said roughened knurled surface.

11. The improvement of claim 10 further comprising said flexible resilient silencer portion of said roller member having a through bore adapted to engage with said roughened surface of said hard rigid spool portion, and said silencer portion having an outer circular periphery with a diameter greater than said diameters of said second annular shoulders of said spool portion.

12. The improvement of claim 10 further comprising a synthetic bushing of nylon material disposed between said spool and said pin.

13. The improvement of claim 10 further comprising said spool treated by a salt bath nitriding process to prevent corrosion.

14. The improvement of claim 10, wherein said flexible, resilient silencer portion of said roller member is constructed of a material capable of withstanding temperatures in a range from 400° F. to −40° F.

15. The improvement of claim 10, wherein the flexible, resilient silencer portion is made of a polyester urethane.

16. The improvement of claim 10, wherein said hard, rigid spool portion is made of a metal material.

17. The improvement of claim 10, wherein said check spring comprises a block of flexible and resilient material capable of withstanding temperatures in a range from 400° F. to −40° F.

18. In a hinge assembly of the type having a body plate adapted to be secured to the body of a vehicle, a door plate pivotally connected about a vertical hinge axis to the body plate and adapted to be secured to a door of the vehicle, and a check spring mounted on one of the plates operably engageable with a striker member carried by the other of the plates to hold the door plate in a door-opened position, the improvement comprising:

said striker member including a roller member mounted on a pin for rotation about a second axis and movable with said other of said plates between a door-closed position and a door-opened position, wherein said roller member is spaced from said one of said plates when in said door-closed position, said roller member engageable with said one of said plates when moving between said door-opened position and said door-closed position causing deflection of said check spring, said roller member having a hard, rigid spool portion and a flexible, resilient silencer portion, said silencer portion adapted to engage said spool portion such that the spool portion and the silencer portion engage said one of said plates when moving between said door-opened and door-closed positions, said spool portion of said roller member formed of a single piece having a first, reduced diameter, annular shoulder interposed between two, longitudinally spaced, enlarged diameter, annular shoulders, said first annular shoulder having a knurled surface engageable with said silencer portion, said roller member including a synthetic bushing of nylon material disposed between said spool and said pin to reduce noise during rotational movement.

* * * * *